United States Patent [19]

Maruyama et al.

[11] 3,933,335

[45] Jan. 20, 1976

[54] CASTING MOLD FOR METALS

[75] Inventors: Nobuo Maruyama, Tokyo; Yasuo Sakaguchi, Iwaki, both of Japan

[73] Assignee: Kureha Kagaku Kogyo Kabushiki Kaisha, Japan

[22] Filed: Mar. 21, 1972

[21] Appl. No.: 236,788

[30] Foreign Application Priority Data

Apr. 1, 1971 Japan ..... 46-19226

[52] U.S. Cl. ..... 249/114; 106/38.28; 164/33; 156/289; 156/344; 162/145; 162/152; 264/29; 264/DIG. 44; 425/89; 425/90; 425/436; 428/368

[51] Int. Cl.[2] ..... A47F 7/00

[58] Field of Search ..... 156/289, 598, 344; 161/406; 117/6,5.1, 5.2, 5.3, 140; 162/141, 145, 146, 152; 425/78, 89, 90, 470, 436; 106/38.2, 38.28; 264/29; 164/72, 14, 33; 249/115

[56] References Cited

UNITED STATES PATENTS

| | | | |
|---|---|---|---|
| 1,918,089 | 7/1933 | Durand | 106/38.28 |
| 2,341,732 | 2/1944 | Marvin | 156/289 |
| 2,618,032 | 11/1952 | Traenkner | 117/5.1 |
| 3,269,889 | 8/1966 | Hutchins | 162/138 |
| 3,284,862 | 11/1966 | Schweikert | 117/5.1 |
| 3,460,606 | 8/1969 | Boddey | 164/33 |
| 3,552,533 | 1/1971 | Solon et al. | 264/29 |
| 3,582,369 | 6/1971 | Nouveau | 164/33 |
| 3,649,196 | 4/1972 | Degginger | 264/29 |
| 3,671,385 | 6/1972 | Trent et al. | 162/152 |
| 3,676,160 | 7/1972 | Bickerdike et al. | 106/38.28 |
| 3,682,595 | 8/1972 | Okuda et al. | 264/29 |
| 3,749,628 | 7/1973 | Nancarrow et al. | 164/137 |

OTHER PUBLICATIONS

"Foundry Cloth Prevents Burnt-In Sand"–Metal Progress, July 1970–p. 21.

"Pluton Foundry Cloth"–Space and Defense Products, 3M Co.–SD–PLUL (20.05)R–Feb. 15, 1970.

*Primary Examiner*—Edward G. Whitby

*Attorney, Agent, or Firm*—Wenderoth, Lind & Ponack

[57] ABSTRACT

Casting mold for metals, wherein paper-like sheet of carbon or graphite fibers is lined onto the inner surface of the mold to prevent seizure phenomenon between the mold and the cast article.

5 Claims, No Drawings

CASTING MOLD FOR METALS

This invention relates to a casting mold for obtaining cast metal such as cast iron, cast steel, copper alloy, and so forth by pouring molten metals into the mold and solidifying the same.

The invention is characterized by lining a papery sheet composed of carbon or graphite fiber of more than 35% by weight to the total weight of the sheet onto the inner surface of the mold so as to prevent the surface of the mold from seizure phenomenon which is liable to cause defects on the molded surface of the cast article.

It has been a common knowledge in the casting technique to apply various sorts of coating material inside the mold so as to prevent the seizure phenomenon from taking place between the casting metal and the constituent materials for the mold. For the coating materials used nowadays, there are those such as graphite, mica, steatite, etc. in powder form as the base material which are given coating capability by adding thereto natural resin, synthetic resin, molasses, clay, organic solvent, water, etc.. Such mold coating material is applied to the inner surface of the mold. However, this sort of coating material is liable to cause cracks at the time of drying after its application, to exfoliate from the mold surface, or to dissolve the binding material for the mold due to the solvent used at the time of coating, thereby causing defects to take place on the surface of the cast articles.

Properties required of the seizure preventive coating material are such that the coating will not produce any structural or qualitative defect on the mold by reacting with the casting metal, and that it will produce an isolating layer between the inner surface of the mold and the casting metal as a buffer for preventing seizure. It is therefore necessary that the coated layer be uniform throughout the mold.

It is therefore the primary object of the present invention to provide improved casting mold for obtaining cast articles of superior surface quality, the inner surface of which is lined with a homogeneous paper-like sheet which is least liable to cause such defects and disadvantages to the cast article inherent in the conventional casting mold.

The object of the present invention as well as the details thereof will become more apparent from the foregoing description of the invention when read in connection with the preferred example thereof.

The paper-like sheet to be used in the present invention can be obtained by mixing carbon or graphite fibers with organic fiber, pulp, or the like, and is made into paper. Depending on necessity, a bonding agent is used for hardening the sheet. It can also be used after perfectly carbonizing the other constituents than the carbon or graphite fibers, as the case may be.

The sheet can be lined onto the surface of the molds by means of adhesives, and the surface layer produced thereby is uniform and free from cracks. When casting metal is poured into the mold, an organic substance existing in the sheet generates a suitable quantity of gas to moderate a thermal contact between the mold and the casting metal. In this case, when carbonaceous or graphitic substance becomes less than 35%, the gas generates excessively to deteriorate the surface state of the cast article inevitably. Further, the carbon or graphite fibers interpose between the mold and the casting metal to prevent the casting metal from penetrating into the mold, whereby cast article having no surface defects can be obtained.

In order to enable the skilled persons in the art to reduce the present invention into practice, the following actual example is presented. It should, however, be noted that the invention is not so limited to this particular example alone, but any modification and change may be made within the ambit of the appended claim.

EXAMPLE

Using cylindrical molds for ductile cast iron having a core of 10mm in radius of curvature, 70mm in length, 5.5 $m^3$ in core volume, and 11$cm^2$ in core surface area, the following theree kinds of casting molds were prepared:

1. the mold having the core surface applied with graphite powder as the coating material;

2. the mold having its core lined with a paper-like sheet weighing 30 $g/m^2$, in which the quantity of the carbon fiber occupies 40% to the total weight of the paper-like sheet according to the present invention; and

3. the mold having the core, on which surface no lining treatment was made.

Ductile cast iron was produced by each of the abovementioned molds. After the cast article was taken out of the mold, the surface portion of the cast article where it contact the inner surface of the mold core was observed. No defect could be found with the cast article made of the mold (2) according to the present invention. Crepes were observed on the cast iron surface produced by the mold (1) which uses graphite powder as the mold coating material, while many surface defects were observed on the cast iron from the mold (3) not lined with the coating material.

Upon examination of the rate of occurrence of the surface defects with respect to more than 1,000 pieces of the cast iron samples obtained from the abovementioned three kinds of the casting molds, occurrence of the faulty article was found nil with the casting mold (2) according to the present invention, while occurrence of such faulty article was 18% with the mold (1) using the graphite mold coating material, and 52% with the mold (3) using no coating material.

What we claim is:

1. In a casting mold for obtention of cast metal articles of superior surface quality, the improvement which comprises a lining adhered to the inner surface of said mold by means of an adhesive, said lining comprising a paper-like sheet of carbon fibers admixed with organic fibers or pulp, said carbon fibers being present in an amount of at least 35 percent by weight.

2. The casting mold according to claim 1, wherein the paper-like sheet contains about 40% of carbon or graphite fibers to the total weight of the sheet, the remainder being organic fibers or pulp.

3. A casting mold according to claim 1 wherein said carbon fibers are graphite fibers.

4. A method for lining a casting mold which comprises adhering a paper-like sheet comprising at least 35 weight percent carbon fibers admixed with organic fibers or pulp to the inner surface of said mold with an adhesive.

5. A method according to claim 4, wherein the paper-like sheet comprises about 40% carbon fibers, the remainder being organic fibers or pulp.

* * * * *

UNITED STATES PATENT AND TRADEMARK OFFICE

CERTIFICATE OF CORRECTION

PATENT NO. : 3,933,335

DATED : January 20, 1976

INVENTOR(S) : Nobuo Maruyama and Yasuo Sakaguchi

It is certified that error appears in the above-identified patent and that said Letters Patent are hereby corrected as shown below:

Page 1, line [73], after "Japan" insert -- and Toyo Boseki Kabushiki Kaishi --.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*